United States Patent [19]

Salzman

[11] Patent Number: 4,566,801

[45] Date of Patent: Jan. 28, 1986

[54] SUBMERSIBLE MIXER ALIGNABLE IN A HORIZONTAL OR VERTICAL MODE

[75] Inventor: Ronald N. Salzman, Rochester, N.Y.

[73] Assignee: General Signal Corporation, Stamford, Conn.

[21] Appl. No.: 662,323

[22] Filed: Oct. 18, 1984

[51] Int. Cl.[4] ..... B01F 5/10

[52] U.S. Cl. ..... 366/343; 366/264; 366/270; 415/217; 415/219 R

[58] Field of Search ..... 366/262, 263, 264, 265, 366/266, 270, 343; 415/216, 217, 219 R; 417/360, 423 R

[56] References Cited

U.S. PATENT DOCUMENTS

| | | | |
|---|---|---|---|
| 2,123,448 | 7/1938 | Weber . | |
| 2,137,921 | 11/1938 | Mathews . | |
| 2,325,754 | 8/1943 | Ebert . | |
| 2,664,242 | 12/1953 | Se Bastian . | |
| 3,524,629 | 8/1970 | Culwell | 366/263 |
| 3,606,273 | 9/1971 | Johnson | 366/263 |
| 3,876,327 | 4/1975 | Lobanoff | 417/323 R |
| 4,378,165 | 3/1983 | Landberg | 366/270 |
| 4,459,030 | 7/1984 | Weetman | 366/262 |

*Primary Examiner*—Robert W. Jenkins
*Attorney, Agent, or Firm*—Robert M. Hallenbeck; Martin LuKacher; Jeffrey S. Mednick

[57] ABSTRACT

A submersible mixer with a housing, within which housing sits a motor and gear box or other drive means, attached to said housing is a high-efficiency impeller, said housing being supported by vanes which baffle liquid flow when being mixed, and which when said impeller axis is aligned vertically form the base, and which when said impeller axis is aligned horizontally form two points of a tripod.

8 Claims, 9 Drawing Figures

SUBMERSIBLE MIXER ALIGNABLE IN A HORIZONTAL OR VERTICAL MODE

The present invention relates to mixing apparatus an particularly for liquids and liquid suspensions which mixer is submersible therein.

In a preferred embodiment, the mixer utilizes a high-efficiency impeller mounted on a housing. Within the housing are means for driving the impeller. The mixer has a plurality of vanes which support the housing. The vanes provide a stand for centrally supporting the mixer with the impeller axis in the vertical position, and partially support the mixer by the tips of two of the vanes with impeller axis in the horizontal position. In both instances, the vanes also operate to baffle the flow of the liquid without any alteration of structure, therefore, the invention can operate vertically for both up flow or down flow or it can operate horizontally simply by changing the orientation of the device.

The known prior art does not suggest any mixing apparatus which can be submerged in a tank for horizontal or vertical flow of the liquid during mixing. There are two basic designs for realigning the direction of operation of propeller blades or mixer. In one design, the entire unit including the blades is shifted from horizontal to vertical operation, or vice versa. In the other design, the base is fixedly mounted but the mixer housing is rotatably mounted to change the direction of operational flow.

In U.S. Pat. No. 2,137,921 (issued to Mathews), arcuate divergent supports are mounted at one end of a motor housing. At the other end of the motor housing, a handle projects out from the housing. The arcuate supports form a base when the unit is aligned vertically and form two points of a tripod (the handle the third) when the unit is aligned horizontally. These projections serve no purpose other than support. The blades extend vertically out from the motor. In the vertical mode, flow is unidirectional.

In U.S. Pat. No. 2,325,754 (issued to Ebert), the motor and impeller are fixedly mounted in a louvered, cylindrical housing. The housing has three fixed feet on one end of the housing which extend beyond the outer dimension circumscribed by housing. It has three feet on the opposite end which rest within the outer dimension. Two of these inner feet are mounted on posts which may be extended outward beyond the outer dimension. Thus, with the bottom of the cylinder facing down the device rests on the three fixed feet. With the cylinder on its side, the two post mounted feet will provide support as a tripod base. None of the feet provide a purpose other than for support. In both alignments, flow is unidirectional.

As examples of the second design, U.S. Pat. Nos. 2,123,448 (issued to Weber) and 2,664,242 (issued to Se Bastian) show a fixed base from which two arcuate members extend. The blades are pivotally mounted to the members allowing the fan to be adjusted accordingly. No purpose is fulfilled by the members other than for support.

In both designs, the supporting members allow some flexibility for realignment of the direction of operation but provide nothing else. Any baffling effect sought, therefore, must be achieved by the addition of other structural elements which will add to the overall complexity of the design.

It is an object of this invention to provide improved mixing apparatus, especially adopted for submersible operation, in which a support means include vanes to allow the mixer to operate in a horizontal or vertical mode while also providing for flow control, such as baffling.

It is a feature of this invention that no adjustments need be made to the apparatus when changing between vertical down flow operation and horizontal side flow operation.

It is a feature if this invention that the support means need not be adjusted for vertical up flow operation.

It is further feature of this invention that the mixing apparatus is fully portable, and adapted to be put into a tank or moved from tank to tank.

It also is a feature of the invention that the support means can include raised legs to allow the liquid to circulate under the vanes during operation in the vertical mode.

Other objects, features and advantages of the invention as well as the presently preferred embodiments and best known modes for practice thereof, will become more apparent from a reading of the following detailed description, which makes reference to the following drawings.

Figure 1:
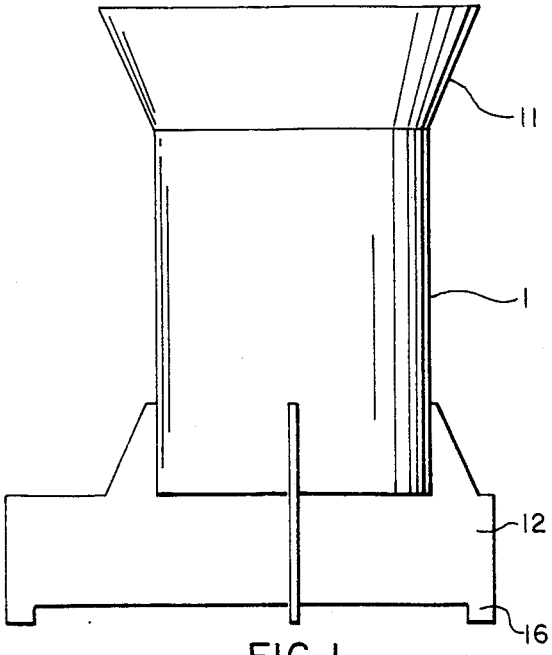
FIG. 1 is an elevational view of a submersible mixer embodying the invention disposed for down flow operation in the vertical mode.
Figure 2:
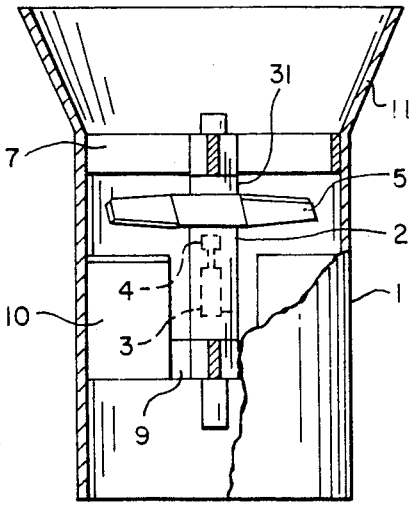
FIG. 2 is a partial sectional view of the submersible mixer apparatus shown in FIG. 1, showing the draft tube, impeller and drive thereof.
Figure 3:
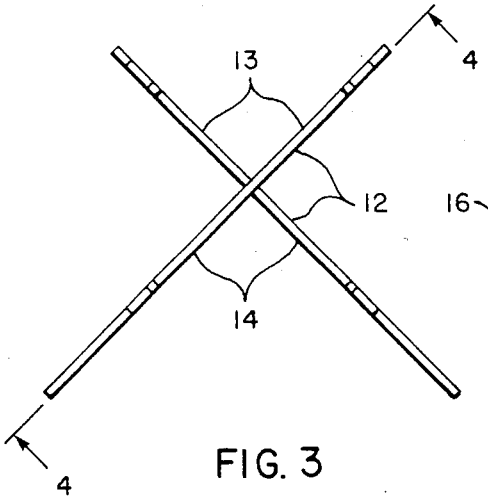
FIG. 3 is a top view of the vanes which provide support for the mixer shown in FIG. 1.

Referring to FIGS. 1–7, a draft tube 1 forms a chamber within which is an impeller 5 for pumping a liquid or liquid suspension (the term "liquid" connotes both liquids and liquid suspensions). Extending from the top of the draft tube is a flared portion which defines a conical tube 11, through which the liquid exits.

The impeller is mounted on a housing 2. A drive motor 3 within the housing 2 is connected to a gear box 4. The gear box transfers power from the motor 3 to a collar 31 of the impeller 5 and rotates the impeller 5. The housing 2 is held centered in the draft tube 1 at the end closest to the conical tube 11 by four arms 7, set in a cruciform manner. At the end opposite the conical tube 11, the housing 2 again is held centered by four arms 9, also are set in a cruciform manner. (See FIG. 6).

Fixed to each of the bottom cruciform arms 9 and extending upward in the same plane as each arm are four internal baffles 10. The internal baffles 10 extend upward from the bottom cruciform arms 9 to a point to allow the impeller 5 sufficient room to rotate freely between the baffles 10 and the upper cruciform arms 7. The baffles are optionally used, suitably when the prevention of non axial flow in the draft tube is needed.

The support for the housing and impeller is provided by the draft tube and two vanes 12, which also define a cruciform. (See FIG. 3).

Figure 4:
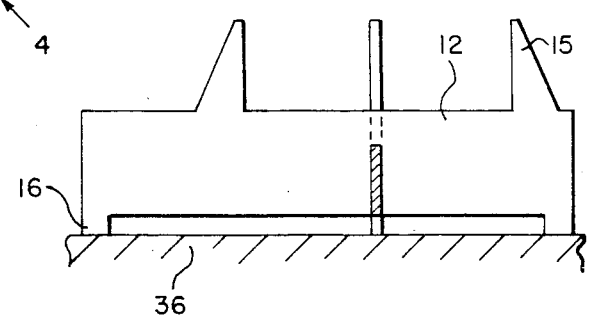
FIG. 4 is a sectional view of the supports taken along the line 4—4 in FIG. 3.

As shown in FIG. 4, the upper portion of each vane comprises two right triangular projections 15. The distance between the inner walls of projections on the same vane corresponds to the outer diameter of the draft tube 1. The width, base and hypotenuse of the right triangular projections 15 also conform to the width, base and slope of the conical tube 11, such that when the draft tube 1 is oriented as in FIG. 7 the draft tube 1 fits over the triangular projection 15 for upflow operation.

The vanes 12 are fixed such that each has an identical short 13 and long 14 portion. (See FIGS. 3 and 6). The vanes 12 sit on legs 16 which allows circulation of liquid under each vane 12, when the mixer vertically disposed, (with the impeller rotational axis vertical) is on the floor 36 of a tank. (See FIG. 4).

Figure 5:
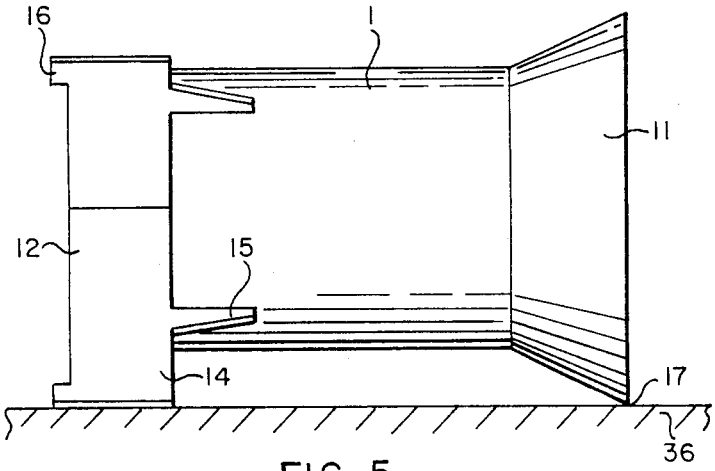
FIG. 5 is an elevational view of the mixer shown in FIG. 1 disposed for operation in the horizontal mode.
Figure 6:
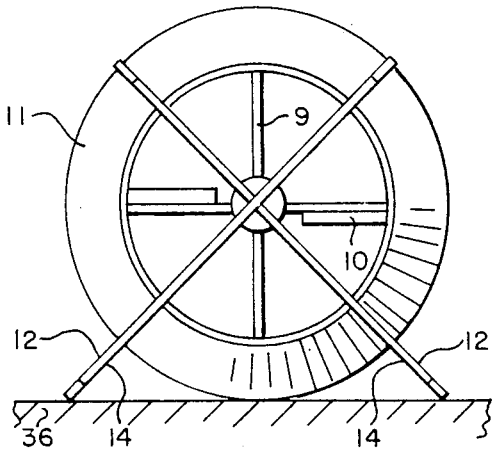
FIG. 6 is an end view of the apparatus shown in FIG. 5.
Figure 7:
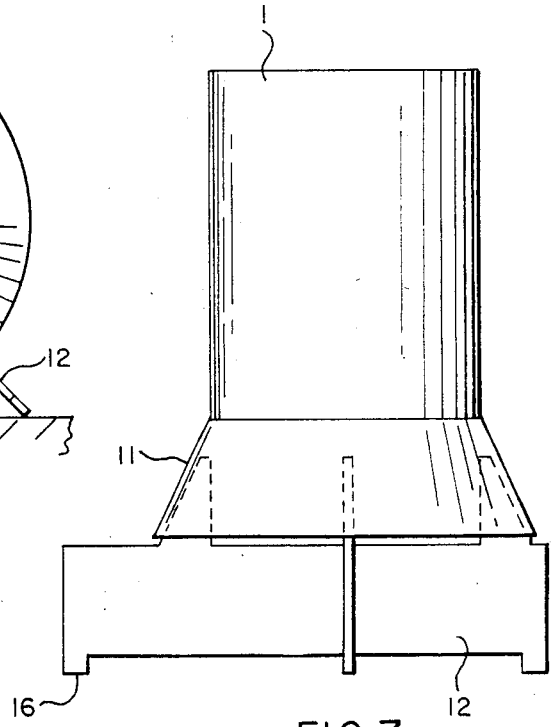
FIG. 7 is an elevational view of the apparatus shown in FIG. 1 disposed for up flow operation in the vertical mode.

When the mixer is horizontally disposed, as in FIGS. 5 and 6, the longer portions of the vanes 14 form two points of a tripod. The remaining point of the tripod 17 is formed by the outermost portion of the conical tube 11 which is of sufficient slope and diameter to keep the impeller axis horizontal.

Figure 8:
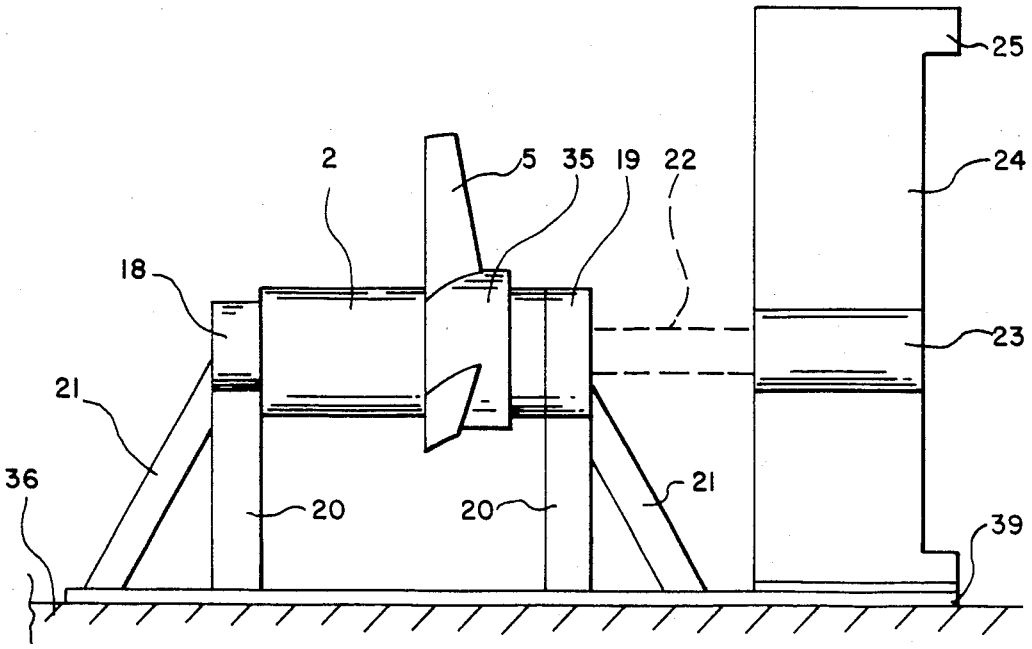
FIG. 8 is an elevational view of a submersible mixer apparatus in accordance with another embodiment of the invention shown disposed for operation in the horizontal mode.
Figure 9:
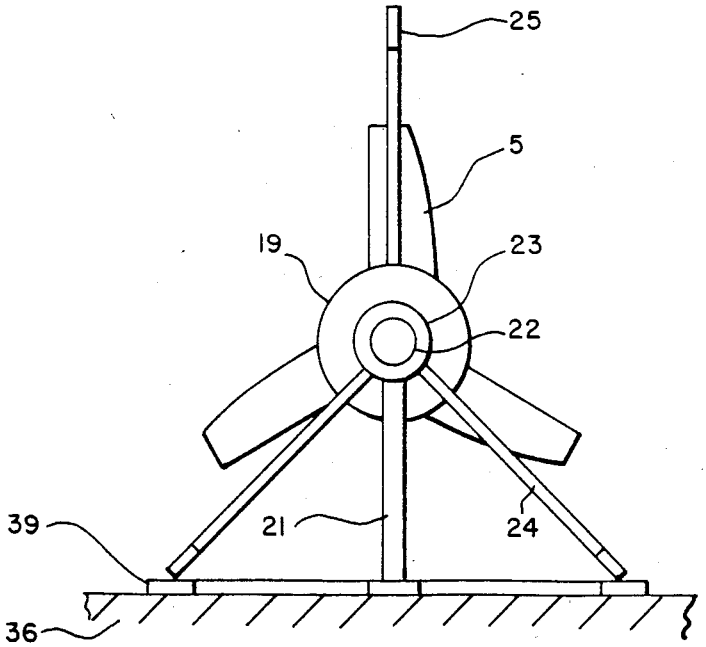
FIG. 9 is an end view of the apparatus shown in FIG. 8.

Referring to FIG. 8 and FIG. 9, (where parts similar to parts described in connection with FIGS. 1–7 are indicated by like reference numerals) the housing 2 has a neck 18 one at one end. The other end has a second neck 19. A rotatable collar 35 is located between the end necks. Extending down at approximately a 45° angle, or any angle sufficient to raise the impeller 5 above the floor 36 of the tank in which it is submerged, on either side of the necks 18 and 19 are legs 20. Likewise, braces 21 are fixed to the necks 18 and 19, and are aligned with each other in the axis of the housing 2 and impeller 5. (See FIGS. 8 and 9). These legs and braces are secured as by welding to a base plate 39.

From the end of the neck 18 and extending in a line parallel to the impeller's axis is a stationary shaft 22. This shaft connects to a hub 23. The hub 23 has three vanes 24 which baffle the liquid being pumped by the impeller. Each vane has two legs 16. Two of the vanes 24 extend to the base plate 39. The base plate may be a beam which supports the legs 20 and braces 21. The shaft 22 from neck 19 to hub 23 is optional because the vanes 24 attached to the base plate 39 are sufficient to provide support for operation in the vertical position. When in the vertical position, the flow is down only.

In the horizontal position, the base plate or beam 39 and two of the vanes 24 form a tripod to support the mixer. In the vertical position (not shown), the vanes 24 sit on legs 25 above the floor 36 which allows the liquid to flow under the vanes from the impeller 5.

Variations and modifications of the herein described device, within the scope of the invention may suggest themselves to those skilled in the art. Accordingly, the foregoing description should be taken as illustrative and not in a limiting sense.

I claim:

1. A submersible mixer which comprises a housing, an impeller rotatably mounted on said housing, a drive means for said impeller in said housing, a support for said housing, said support having a plurality of vanes at one end of said support defining a stand for aligning said housing with the axis of rotation of said impeller vertical, said support having an extension at the end of said support opposite to said vanes, said extension defining at least one point of support in a horizontal plane, said vanes defining at least two other points of support in said horizontal plane for aligning said housing with said axis of said impeller horizontal.

2. The submersible mixer as set forth in claim 1 wherein said support further comprises a draft tube, said housing being mounted within said draft tube by a centering means, said draft tube having said extension comprising a conical tube at one end, said one end which defines said one point of support when aligned horizontally.

3. The submersible mixer as set forth in claim 2 wherein said vanes defining a cruciform base for aligning said housing with its axis vertical and said vanes defining said two points of support along edges thereof supporting said housing with said impeller axis horizontal.

4. The submersible mixer as set forth in claim 3 wherein said vanes each have two right triangular projections, the inner sides of which are spaced slightly larger than the diameter of said draft tube apart and the hypotenuse of said projections conforms to the angle of siad conical tube on said draft tube, such that when the impeller is aligned vertically the conical tube fits over said projections.

5. The submersible mixer as set forth in claim 2 wherein said centering means comprises two sets of four cruciforms arms fixedly attached to said draft tube and disposed axially spaced from each other along said housing, said first set at the end proximate to said flared portion of said draft tube and second set fixed to the end opposite said flared portion of said draft tube.

6. The invention as set forth in claim 6 wherein the arms closest to the end of said draft tube opposite said conical tube has baffles attached thereto which extend away from said one end of said draft tube to a region defining a space within which said impeller is disposed.

7. The submersible mixer as set forth in claim 1 wherein said drive means comprises a power source, a motor and a gear box.

8. The invention as set forth in claim 1 wherein the ends of said vanes have legs for allowing circulation of liquid beneath the vanes when said impeller axis is disposed vertically.

* * * * *